US010069226B2

(12) United States Patent
Sauer et al.

(10) Patent No.: US 10,069,226 B2
(45) Date of Patent: Sep. 4, 2018

(54) POWER DISTRIBUTION MODULE

(71) Applicant: Murrelektronik, Inc., Suwanee, GA (US)

(72) Inventors: Fred W Sauer, Saint Paul, MN (US); Scott C Schmitz, Shakopee, MN (US); Eric W Mueller, Minneapolis, MN (US); Nils A Bergman, Plymouth, MN (US)

(73) Assignee: Murrelektronik, Inc., Suwanee, GA (US)

( * ) Notice: Subject to any disclaimer, the term of this patent is extended or adjusted under 35 U.S.C. 154(b) by 0 days.

(21) Appl. No.: 15/655,594

(22) Filed: Jul. 20, 2017

(65) Prior Publication Data

US 2018/0219313 A1 Aug. 2, 2018

Related U.S. Application Data

(60) Provisional application No. 62/452,720, filed on Jan. 31, 2017.

(51) Int. Cl.

| | |
|---|---|
| ***H01R 12/70*** | (2011.01) |
| ***H01R 25/00*** | (2006.01) |
| ***H01R 13/717*** | (2006.01) |
| ***H01R 12/71*** | (2011.01) |
| ***H01R 13/629*** | (2006.01) |
| ***H01R 12/58*** | (2011.01) |

(52) U.S. Cl.

CPC ..... *H01R 12/7088* (2013.01); *H01R 12/58* (2013.01); *H01R 12/716* (2013.01); *H01R 13/629* (2013.01); *H01R 13/7175* (2013.01); *H01R 25/00* (2013.01)

(58) Field of Classification Search

CPC ..... H05K 1/0201; H01R 13/717; H01R 13/7175; H01R 13/6271; H01R 12/716; H01R 12/724; Y10S 439/91

USPC ..... 439/76.1, 357, 76.2, 485, 490, 910

See application file for complete search history.

(56) References Cited

U.S. PATENT DOCUMENTS 4,211,461 A * 7/1980 Wescott ..... H01R 13/6271 285/362

4,218,724 A * 8/1980 Kaufman ..... H05K 5/0091 361/709

(Continued)

OTHER PUBLICATIONS

Murrelektronik, Chapter 4: I/O Systems, Main Catalog, Jan. 10, 2014, pp. 1-205, www.murrinc.com/us/service/main-catalog.html, Murrlektronik, Atlanta, Georgia.

(Continued)

*Primary Examiner* — Tho D Ta
*Assistant Examiner* — Marcus Harcum
(74) *Attorney, Agent, or Firm* — Thomas B. McGurk

(57) ABSTRACT

A power distribution module for use on mobile equipment is described in the present disclosure and can include a housing having a power input port and a plurality of output ports integrally formed with the housing and open to an outer surface of the housing. Each of the input port and the output ports are configured to receive and secure a connector that is pushed and locked into place, thereby sealing the connection. The power distribution module can be used to split a single power line into multiple lines connected to electrical devices mounted on a piece of mobile equipment.

16 Claims, 14 Drawing Sheets

(56) References Cited

U.S. PATENT DOCUMENTS 4,526,431 A * 7/1985 Kasukawa ..... G02B 6/3877 439/153
5,309,121 A * 5/1994 Kobayashi ..... H01P 3/081 333/246
5,622,506 A * 4/1997 Hornig ..... B60R 16/0238 439/540.1
5,807,140 A * 9/1998 Hopkins ..... H01R 31/005 361/679.4
5,973,409 A 10/1999 Neibecker et al.
6,062,903 A * 5/2000 Hawes ..... H01R 12/57 174/261
6,150,734 A 11/2000 Neibecker et al.
6,340,848 B1 1/2002 Maeda
6,347,958 B1 * 2/2002 Tsai ..... G01R 31/3686 340/653
6,386,891 B1 * 5/2002 Howard ..... H01R 13/74 439/731
6,472,772 B2 10/2002 Onizuka
6,600,236 B2 7/2003 Rhodes
6,634,892 B2 10/2003 Nakamura
6,634,910 B2 * 10/2003 Lieb ..... H05K 7/1465 439/271
6,650,024 B2 11/2003 Yamane et al.
6,881,101 B2 * 4/2005 Sichner ..... H01R 13/514 439/278
7,007,179 B2 2/2006 Mares et al.
7,034,641 B1 * 4/2006 Clarke ..... G02B 6/4201 333/247
7,101,199 B2 * 9/2006 Yamashita ..... H05K 7/026 439/76.1
7,132,761 B2 11/2006 Rhodes
7,443,056 B2 * 10/2008 Fisher ..... H01R 9/2425 307/116
7,976,336 B2 * 7/2011 Yang ..... H01R 13/717 439/490
8,074,680 B2 * 12/2011 De Carolis ..... F15B 13/0857 137/560
2006/0077643 A1 * 4/2006 Mayuzumi ..... H05K 3/284 361/753
2006/0141820 A1 * 6/2006 Naito ..... H01R 9/2458 439/76.1
2007/0117440 A1 * 5/2007 Nagashima ..... H01R 13/521 439/271
2007/0117450 A1 * 5/2007 Truxes ..... F21V 23/06 439/490
2008/0119066 A1 * 5/2008 Shimizu ..... H01R 9/226 439/76.1
2010/0130029 A1 * 5/2010 Williams ..... H05K 1/0293 439/65

OTHER PUBLICATIONS

IFM Electronic GMBH, CR2032, Ecomat 100, pp. 1-15, Aug. 14, 2014, IFM Electronic GmbH, Essen, Germany.
Pran Systems Inc., Electrical System Management Solutions for OEM, www.pransystems,com, pp. 1-8, Pran Systems Inc. , Quebec Canada.
Data Panel Corp., Valve Drive Module, www.datapanel.com, Jun. 22, 2015, Data Panel Corp., Minneapolis, MN 55439.

* cited by examiner

POWER DISTRIBUTION MODULE

TECHNICAL FIELD

The present disclosure is directed to power distribution modules and, more particularly, to power distribution modules for use in mobile equipment.

BACKGROUND

In mobile equipment, especially mission-specific vehicles, such as agricultural machines, railway and construction equipment, fire and rescue trucks, road and utility maintenance vehicles, and garbage collection trucks, several different electrically-powered devices located throughout the vehicle must be connected to the vehicle's power generation/electrical system. In traditional systems, each electrical device is individually hardwired to the vehicle's electrical system. If an electrical device malfunctions, the individual hardwiring must be traced, inspected and replaced, leading to significant effort and downtime to address.

Consequently, there is a need for a power distribution module that can better address these and other challenges.

SUMMARY

The present disclosure encompasses power distribution modules usable on mobile equipment. The present disclosure encompasses a power distribution module for use on mobile equipment comprising a housing comprising a front face; a power input port integrally formed with the housing, wherein the power input port comprises an input port sidewall, a first input port wedge-lock receiver formed in the input port sidewall, a second input port wedge-lock receiver formed in the input port sidewall, a first input port wedge-lock retention tab receiver formed in the first input port wedge-lock receiver, and a second input port wedge-lock retention tab receiver formed in the second wedge-lock receiver; a plurality of output ports integrally formed with the housing, wherein each output port of the plurality of output ports comprises an output port sidewall, an output port wedge-lock receiver formed in the output port sidewall, and an output port wedge-lock retention tab receiver formed in the output port wedge-lock receiver; a printed circuit board disposed within the housing, wherein the printed circuit board comprises an input port junction and a plurality of output port junctions, wherein each output port junction of the plurality of output port junctions is in electrical communication with the input port junction; a plurality of input pins connected to the printed circuit board at the input port junction, wherein each input pin of the plurality of input pins is operably aligned with the power input port; a plurality of output pins connected to the printed circuit board, wherein each output pin of the plurality of output pins is connected to the printed circuit board at one output port junction of the plurality of output port junctions, and wherein each output pin of the plurality of output pins is operably aligned with one output port of the plurality of output ports; a light emitting diode connected to the printed circuit board, wherein the light emitting diode is in electrical communication with the input port junction; a translucent resin layer disposed between at least a portion of the printed circuit board and the housing, wherein the light emitting diode is disposed between the translucent resin layer and the printed circuit board, and wherein the translucent resin layer contacts at least a portion of the printed circuit board; and, a thermally conductive resin layer disposed adjacent the printed circuit board and the housing, wherein the thermally conductive resin layer contacts at least a portion of the printed circuit board.

In another aspect, the printed circuit board can further comprise a fixed trace connected to the input port junction and at least one output port junction of the plurality of output port junctions. In yet another aspect, the fixed trace can comprise copper. In still a further aspect, the fixed trace can exhibit a width in the range of about 7 mm to about 18 mm and/or a thickness of about 0.07 mm. In still a further aspect, the translucent resin layer and the thermally conductive resin layer cooperate to encase the printed circuit board. In another aspect, a portion of each output pin of the plurality of output pins can be disposed in the thermally conductive resin layer and a portion of each output pin of the plurality of output pins projects through the translucent resin layer into one output port of the plurality of output ports. In a further aspect, the plurality of output ports can be aligned on the front face of the housing and/or the power input port can be aligned on the front face of the housing. In another aspect, the power input port can comprise eighteen input pins disposed therein, wherein each input pin of the eighteen input pins can be connected to the input port junction. In a further aspect, each output port of the plurality of output ports can comprise four output pins disposed therein, wherein each output pin of the four output pins can be connected to one output port junction of the plurality of output port junctions. In still a further aspect, the power distribution module can further comprise a plurality of first input/output signal paths formed on the printed circuit board and a plurality of second input/output signal paths formed on the printed circuit board, wherein each output port junction of the plurality of output port junctions is connected to one input/output signal path of the first plurality of input/output signal paths and to one input/output signal path of the second plurality of input/output signal paths, and wherein the input port junction is connected to each input/output signal path of the plurality of first input/output signal paths and to each input/output signal path of the plurality of second input/output signal paths, and wherein each output port junction of the plurality of output port junctions is in electrical communication with the input port junction through one input/output signal path of the first plurality of input/output signal paths and through one input/output signal path of the second plurality of input/output signal paths. In another aspect, each output port junction of the plurality of output port junctions can be in electrical communication with one constant-current diode of a first plurality of constant-current diodes and one light emitting diode of a first plurality of light emitting diodes. In still another aspect, each output port junction of the plurality of output port junctions can be in electrical communication with one constant-current diode of a second plurality of constant-current diodes and one light emitting diode of a second plurality of light emitting diodes.

Additionally, the present disclosure encompasses a power distribution module for use on mobile equipment comprising a housing; a power input port integrally formed on an outer surface of the housing, wherein the power input port comprises an input port sidewall, an input port wedge-lock receiver, and an input port wedge-lock retention tab receiver; a plurality of output ports integrally formed on the outer surface of the housing, wherein each output port of the plurality of output ports comprises an output port sidewall, an output port wedge-lock receiver, and an output port wedge-lock retention tab receiver formed in the output port wedge-lock receiver; a printed circuit board disposed within the housing, wherein the printed circuit board comprises an input port junction and a plurality of output port junctions, wherein each output port junction of the plurality of output port junctions is in electrical communication with the input port junction; a plurality of input pins connected to the printed circuit board at the input port junction, wherein each input pin of the plurality of input pins is operably aligned with the power input port; a plurality of output pins connected to the printed circuit board, wherein each output pin of the plurality of output pins is connected to the printed circuit board at one of the output port junctions, and wherein each output pin of the plurality of output pins is operably aligned with one output port of the plurality of output ports; a plurality of light emitting diodes disposed in the housing, wherein each output port junction of the plurality of output port junctions is in electrical communication with at least one light emitting diode of the plurality of light emitting diodes; and, a plurality of constant-current diodes disposed in the housing, wherein each constant-current diode of the plurality of constant-current diodes is in electrical communication with one output port junction of the plurality of output port junctions and one light emitting diodes of the plurality of light emitting diodes.

In another aspect, the housing can comprise a glass-filled nylon 6,6 polymeric compound. In a further aspect, the printed circuit board can be sealed by resin disposed in the housing. In yet another aspect, each output pin can extend through the resin and project into one output port. In still a further aspect, the printed circuit board further can comprise a fixed trace formed of copper and connected to the input port junction and to each output port junction of the plurality of output port junctions, wherein the fixed trace can exhibit a width in the range of about 7 mm to about 18 mm and a thickness of about 0.07 mm.

The present disclosure also encompasses a power distribution module for use on mobile equipment comprising a housing comprising a front face, wherein the housing comprises a glass-filled nylon 6,6 polymeric compound; a power input port integrally formed on the front face of the housing, wherein the power input port comprises an input port sidewall, a first input port wedge-lock receiver formed in the input port sidewall, a second input port wedge-lock receiver formed in the input port sidewall, a first input port wedge-lock retention tab receiver formed in the first input port wedge-lock receiver, and a second input port wedge-lock retention tab receiver formed in the second wedge-lock receiver, wherein the power input port comprises a glass-filled nylon 6,6 polymeric compound; a plurality of output ports integrally formed on the front face of the housing, wherein each output port of the plurality of output ports comprises an output port sidewall, an output port wedge-lock receiver formed in the output port sidewall, and an output port wedge-lock retention tab receiver formed in the output port wedge-lock receiver, wherein each output port of the plurality of output ports comprises a glass-filled nylon 6,6 polymeric compound; a printed circuit board disposed within the housing, wherein the printed circuit board comprises an input port junction, a plurality of output port junctions, and a fixed trace connected to the input port junction and each output port junction of the plurality of output port junctions, wherein each of the plurality of output port junctions is in electrical communication with the input port junction; a plurality of input pins connected to the printed circuit board at the input port junction, wherein each of the plurality of input pins are operably aligned with and press fitted into the power input port; a plurality of output pins connected to the printed circuit board, wherein each of the plurality of output pins is connected to the printed circuit board at one output port junction of the plurality of output port junctions, and wherein each output pin of the plurality of output pins is operably aligned with and press fitted into one output port of the plurality of output ports; a plurality of light emitting diodes disposed on the printed circuit board, wherein each output port junction of the plurality of output port junctions is in electrical communication with at least one light emitting diode of the plurality of light emitting diodes; a plurality of constant-current diodes disposed on the printed circuit board, wherein each constant-current diode of the plurality of constant-current diodes is in electrical communication with one output port junction of the plurality of output port junctions and one light emitting diodes of the plurality of light emitting diodes; a translucent resin layer disposed between at least a portion of the printed circuit board and the housing, wherein the translucent resin layer is disposed between the plurality of light emitting diodes and the housing, and wherein the translucent resin layer contacts at least a portion of the printed circuit board; and, a thermally conductive resin layer disposed adjacent the printed circuit board, wherein the thermally conductive resin layer contacts at least a portion of the printed circuit board, wherein the printed circuit board is sealed by the translucent resin layer and the thermally conductive resin layer.

These and other aspects of the present disclosure are set forth in more detail below and illustrated in the drawings, which are briefly described as follows.

DETAILED DESCRIPTION

The present disclosure is directed to power distribution modules that are usable in mobile equipment environments such as on commercial and emergency vehicles. The power distribution modules encompassed by the present disclosure provide a central power distribution point from which a plurality of electrical devices mounted on a vehicle can be supplied with power through connectors operably connected to the power distribution module. The power distribution modules encompassed by the present disclosure can be used as substitutes for manually wired junction boxes or fabricated wire harnesses to distribute power, ground and/or signals passively to electrically-powered devices mounted on mobile equipment. The power distribution modules encompassed by the present disclosure can be used to send, receive and/or manage electrical signals in a mobile equipment environment, including, but not limited to, in conjunction with electrically-powered devices mounted on mobile equipment that have the same name and/or function, thereby requiring a splitting or joining of signals to or from two or more different locations, such as, for example, left or right turn signals on a vehicle that lead to multiple turn signal indicator light emitting diodes disposed around the vehicle.

The power distribution modules encompassed by the present disclosure can be formed of material suitable for protecting electrical components from environmental effects, such as water, chemicals, dirt and vibration. Such materials of construction can comprise, for example, a metal or a synthetic material, such as a thermoplastic-containing material, such as glass-filled nylon 6,6, that can withstand without significant degradation over an extend period of use, automotive chemicals, such as motor oils, fuels, coolants, brake fluids, and automotive cleaners, dust, dirt and other environmental contaminants commonly encountered by vehicles.

Figure 1:
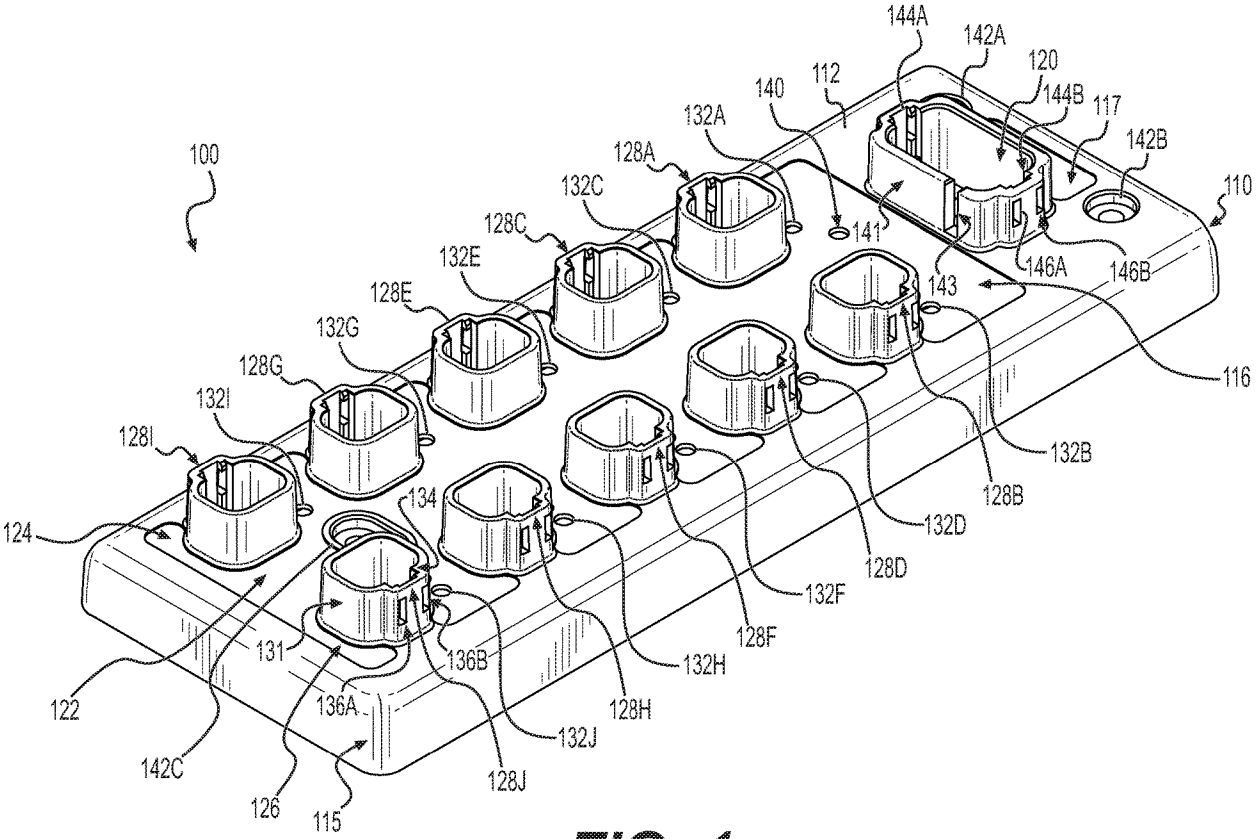
FIG. 1 illustrates a perspective view of a power distribution module encompassing aspects of the present disclosure.
Figure 2:
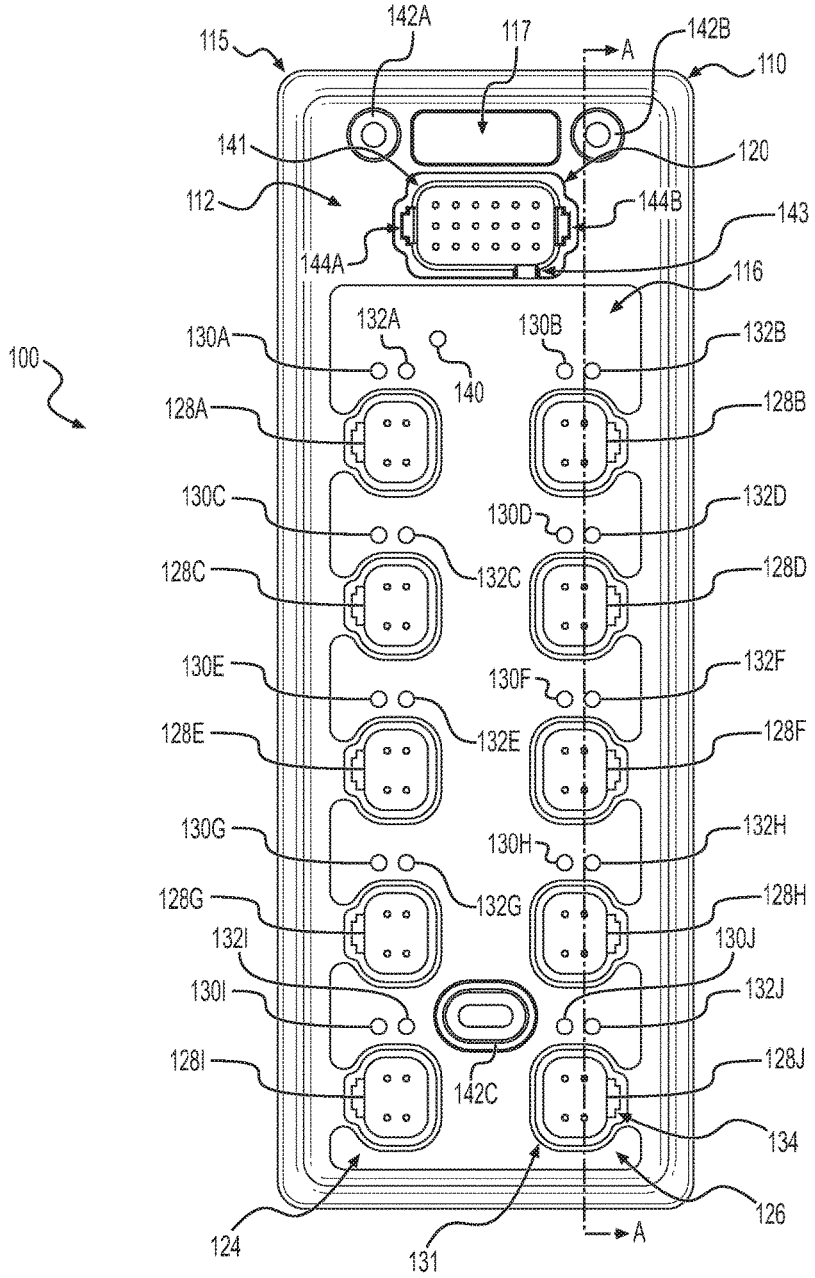
FIG. 2 is a front elevation view of the power distribution module shown in FIG. 1.
Figure 3:
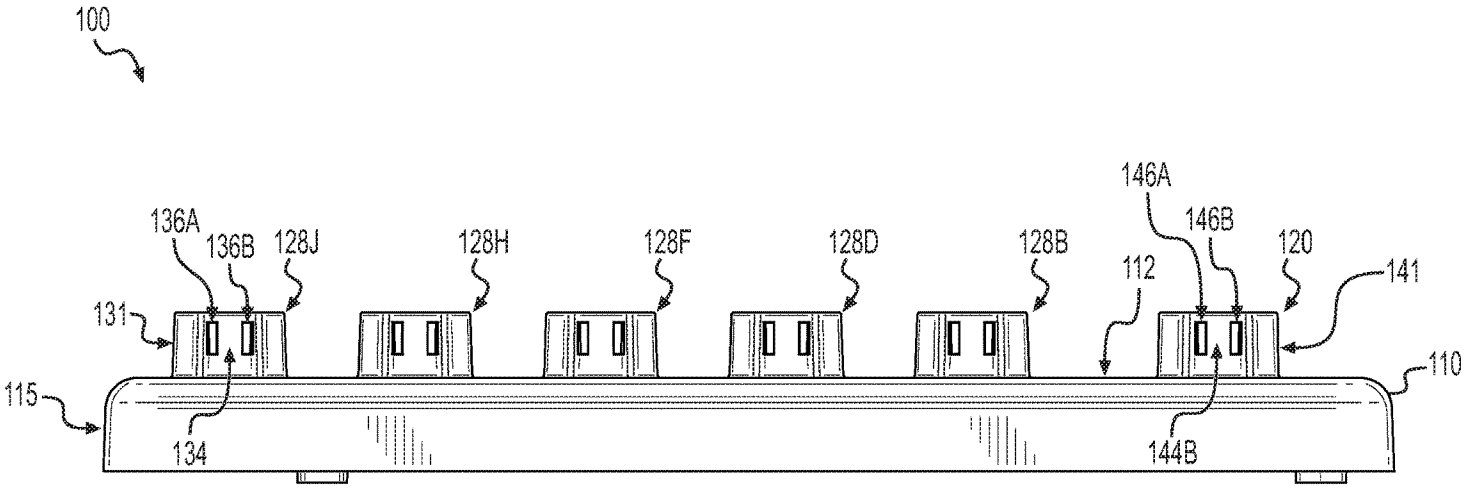
FIG. 3 is a side view of the power distribution module shown in FIG. 1.
Figure 4:
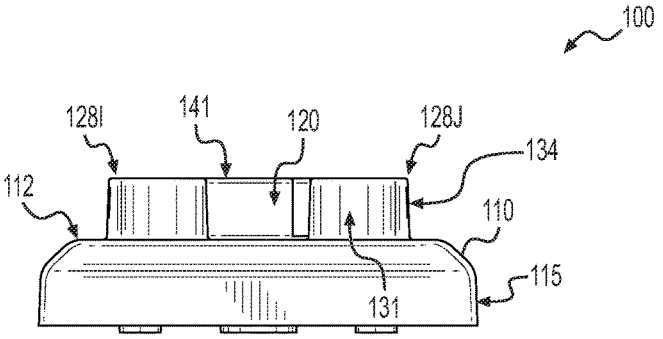
FIG. 4 is a bottom elevation view of the power distribution module shown in FIG. 1.

As used herein, the singular forms of "a," "an," and "the" encompasses the plural form thereof unless otherwise indicated. As used herein, the phrase "at least one" includes all numbers of one and greater. As used herein, the term "and/or" refers to one or all of the listed elements or a combination of any two or more of the listed elements. As used herein, the term "operably connected" refers to the relationship between two or more components whereby the interconnection of the components is such as to allow for the intended operation of the components, either singly or in combination. As used herein, the term "operably aligned" refers to the relationship between two or more components whereby the alignment of one component with another component allows for the intended function of the one component with the other component. As used herein, the term "in electrical communication" refers to the relationship between two or more components whereby the components are interconnected in such a way so as to allow a current of electricity to flow between the two or more components. As used herein, the term "integrally formed" refers to the formation of one component of the same material and/or seamless integration of one component with another component. As used herein, the term "mobile equipment" refers to and includes, but is not limited to, automobiles, trucks, tractors, trailers, locomotives and other railway equipment, aircraft, watercraft, mobile agricultural equipment, and/or wheeled or tracked industrial vehicles and mobile industrial equipment, FIGS. 1-14 illustrate various aspects of the power distribution modules encompassed by the present disclosure. In FIGS. 1-4, a power distribution module 100 is shown comprising a body 110. The body 110 comprises a housing 115 on which is formed a front face 112. The housing 115 has an outer surface that extends around the body and is not otherwise covered by another part of the housing 115 or a door or cover. As shown in FIGS. 1 and 2, the power distribution module 100 comprises a power input port 120, which is aligned on and opens to the front face 112 of the body 110. The power input port 120 comprises an input port sidewall 141 projecting from the front face 112 of the body 110 of the power distribution module 100. The input port sidewall 141 comprises a first input wedge-lock receiver 144A aligned on one side of the input port sidewall 141 and a second input wedge-lock receiver 144B aligned on an opposing side of the input port sidewall 141. The input port sidewall 141 forms a female sleeve for receiving a male configured power input connector, not shown, connected to a wire assembly electrically connected to a vehicle's power/electrical system. Each of the first and the second input port wedge-lock receivers 144A and 144B comprises a first input port wedge-lock retention tab receiver 146A and a second input port wedge-lock retention tab receiver 146B formed therein. The input port sidewall 141 also defines a guide receiver notch 143 for receiving a guide formed on a power input connector, wherein the alignment of the guide with the guide receiver notch 143 ensures proper orientation of the power input connector when inserted into the power input port 120. The first and the second input port wedge-lock receivers 144A and 144B are each configured to receive an input wedge-lock formed on opposing sides of a power input connector to be inserted into the power input port 120. Each of the first and the second input port wedge-lock retention tab receivers 146A and 146B formed on each of the first and the second input port wedge-lock receivers 144A and 144B are configured to receive and engage one of two retention tabs formed on a power input connector, not shown, so as to lock in position the input power connector once it is inserted into the power input port 120. The power input port 120 is configured as a Deutsch-type connector with 18 pins. The power input port 120 is configured as a receiver for a DT14-18PA-K004 18 pin model connector with a mating connector equivalent to a DT16-18SA 18 pin model connector. The present disclosure encompasses alternative forms of connector receivers that latchably connect and lock in place a connector pushed into the receiver.

FIGS. 1-4 also illustrate a plurality of output ports 128A, 128B, 128C, 128D, 128E, 128F, 128G, 128H, 128I, and 128J projecting from the front face 112 of the body 110 of the power distribution module 100. The ten output ports 128A, 128B, 128C, 128D, 128E, 128F, 128G, 128H, 128I, and 128J are configured into a first column 124 comprising five output ports 128A, 128C, 128E, 128G, and 128I, and a second column 126 comprising output ports 128B, 128D, 128F, 128H, and 128I. Each of the ten output ports 128A, 128B, 128C, 128D, 128E, 128F, 128G, 128H, 128I, and 128J comprise an output port sidewall 131 that defines a sleeve for receiving an output connector attached to a wire assembly connected to an electrical device mounted on a vehicle. Each of the ten output port sidewalls 131 also defines an output port wedge-lock receiver 134 configured to receive a wedge-lock formed on an output connector, not shown. Each output port wedge-lock receiver 134 comprises a first output port retention tab receiver 136A and a second output port retention tab receiver 136B for receiving and engaging one of two retention tabs formed on a wedge-lock of an output connector inserted into the particular output port. The output ports 128A, 128B, 128C, 128D, 128E, 128F, 128G, 128H, 128I, and 128J can be configured as receivers for a Deutsch-type DT15-4PA 4 pin models connector with a mating connector equivalent to a DT06-4SA 4 pin model connector.

Each of the power input port 120 and the output ports 128A, 128B, 128C, 128D, 128E, 128F, 128G, 128H, 128I, and 128J are configured to receive an appropriately configured connector that can be pushed into place and secured by engagement of a lock formed on the connector by a receiver formed on the port. The power input port 120 and the output ports 128A, 128B, 128C, 128D, 128E, 128F, 128G, 128H, 128I, and 128J are configured to form a water-resistant seal with an appropriately configured connector connected thereto and operably connect to the respective connector to form a circuit between an electrical device and the power distribution module 100 and/or the power system of a vehicle. Each of the power input port 120 and the output ports 128A, 128B, 128C, 128D, 128E, 128F, 128G, 128H, 128I, and 128J are molded into the housing 115 and, thereby are integrally formed with the front face 112 of the body 110 of the power distribution module 100. The molding of the ports in the housing can facilitate the formation of a water-resistant seal at each port when a connector is inserted therein.

Figure 6:
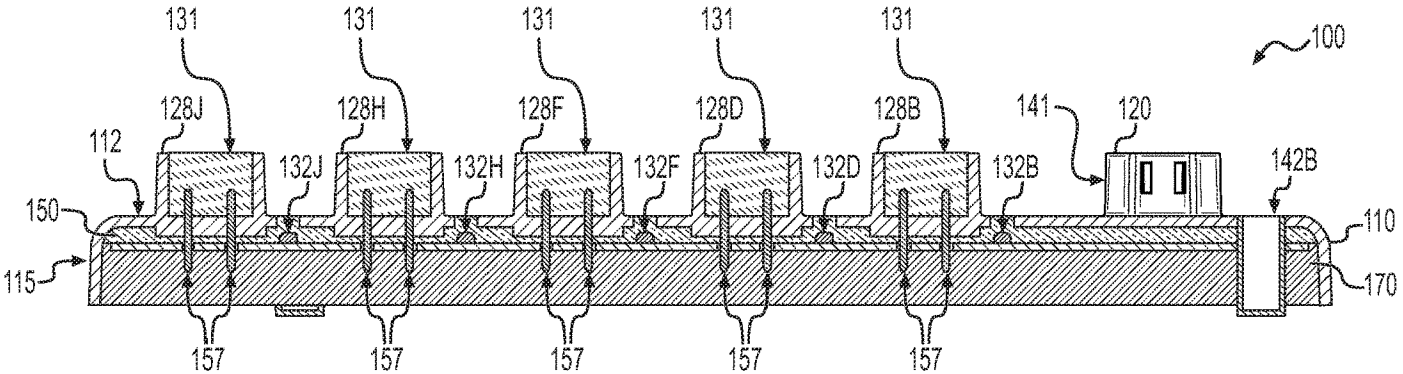
FIG. 6 is a cross-sectional view of the power distribution module shown in FIG. 2 taken along line A-A.
Figure 9:
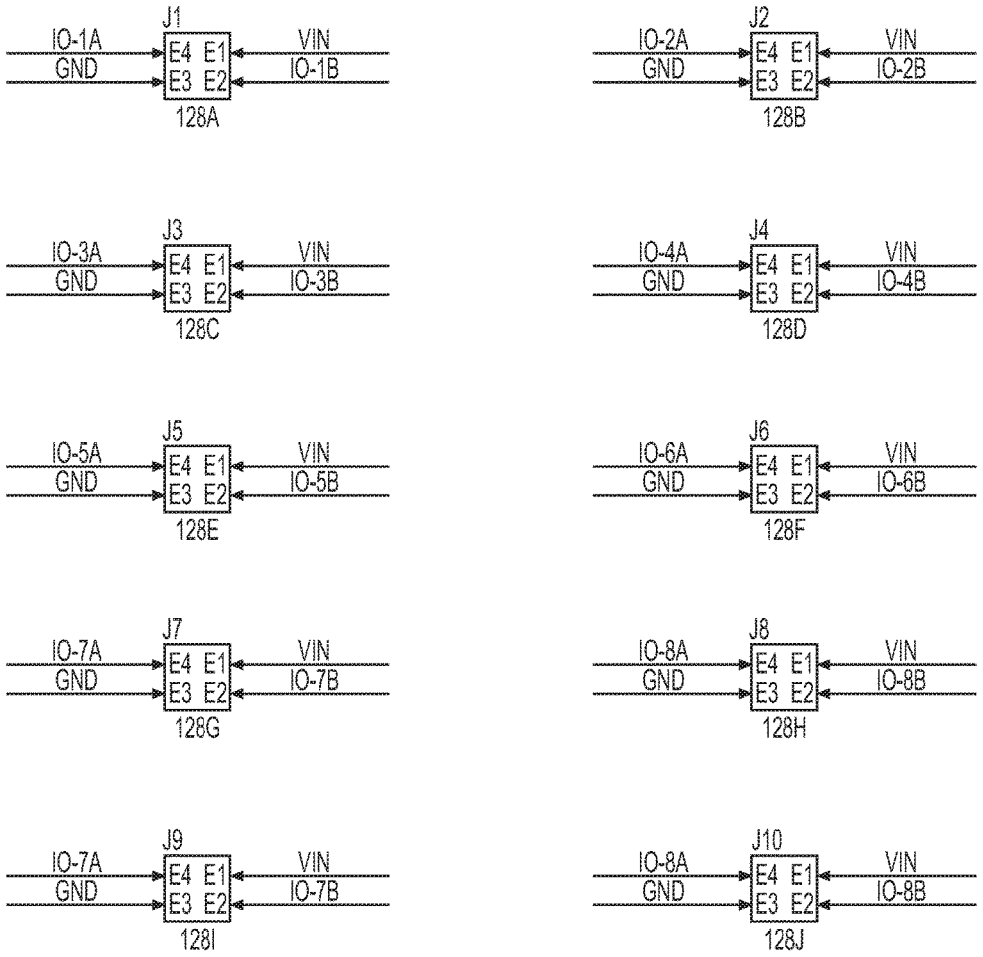
FIG. 9 illustrates a schematic view of the output connectors of the power distribution module of FIG. 2 illustrating the electrical connections between each output connector and the input connector, VIN and ground.

As shown in FIGS. 1, 2 and 6, the power distribution module 100 comprises a plurality of light emitting diodes or LEDs. A module power indicator light emitting diode light emitting diode 140 is aligned visible through an opening formed in the housing 115 from the front face 112 of the body 110 of the power distribution module 100 and indicates if power is supplied to the power distribution module 100. Adjacent each output port is aligned a first signal indicator light emitting diode and a second signal indicator light emitting diode. Accordingly, each of the output ports 128A, 128B, 128C, 128D, 128E, 128F, 128G, 128H, 128I, and 128J have aligned therewith a first signal indicator light emitting diode 130A, 130B, 130C, 130D, 130E, 130F, 130G, 130H, 130I, and 130J and a second signal indicator light emitting diode 132A, 132B, 132C, 132D, 132E, 132F, 132G, 132H, 132I, and 132J, respectively. Each first signal indicator light emitting diode 130A, 130B, 130C, 130D, 130E, 130F, 130G, 130H, 130I, and 130J indicates the signal state for pin E4, as shown in FIG. 9, in each respective output port 128A, 128B, 128C, 128D, 128E, 128F, 128G, 128H, 128I, or 128J as an "on" or "off" state. Each second signal indicator light emitting diode 132A, 132B, 132C, 132D, 132E, 132F, 132G, 132H, 132I, and 132J indicates the signal status of pin E2, as shown in FIG. 9, in each respective output port 128A, 128B, 128C, 128D, 128E, 128F, 128G, 128H, 128I, or 128J as an "on" or "off" state.

Figure 7:
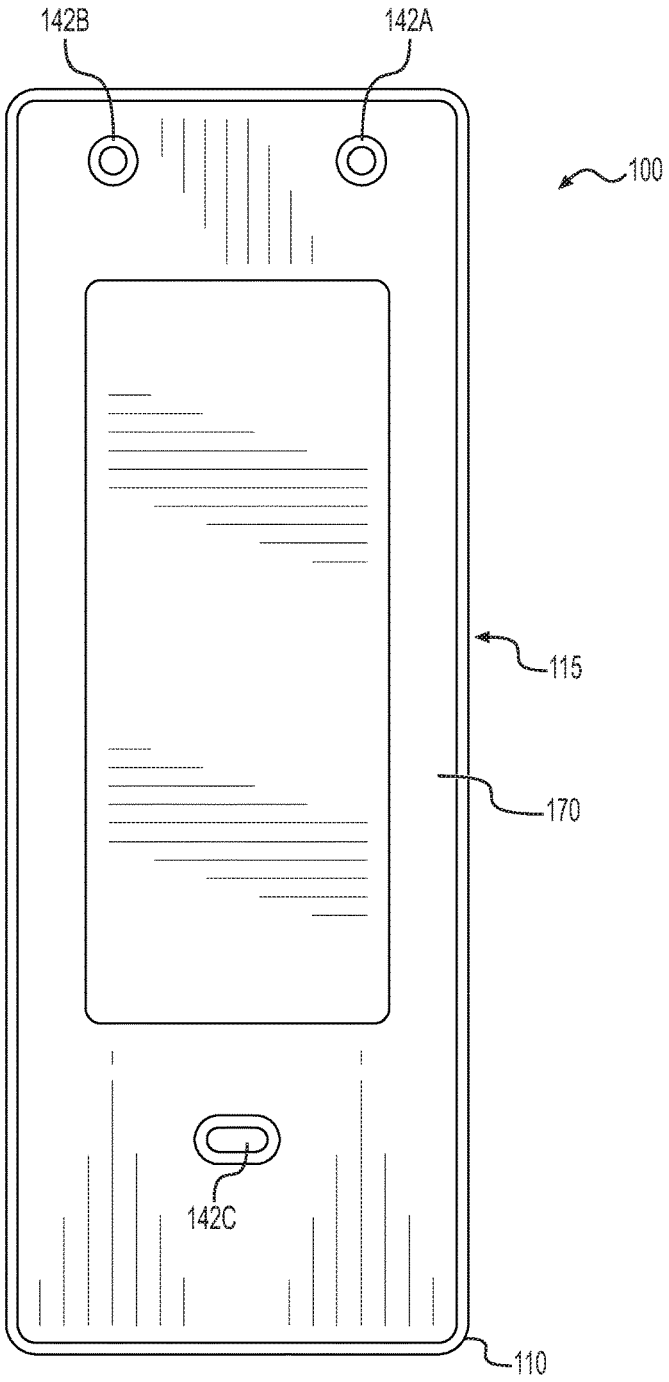
FIG. 7 is a rear elevation view of the power distribution module shown in FIG. 1.

As shown in FIGS. 1, 2, and 7, the power distribution module 100 also comprises three bosses 142A, 142B and 142C formed in the body 110 thereof. Each boss 142A, 142B, and 142C extends through the body 110 and is configured to receive a fastener therein so as to allow the power distribution module 100 to be mounted to a surface of a vehicle.

Figure 5:
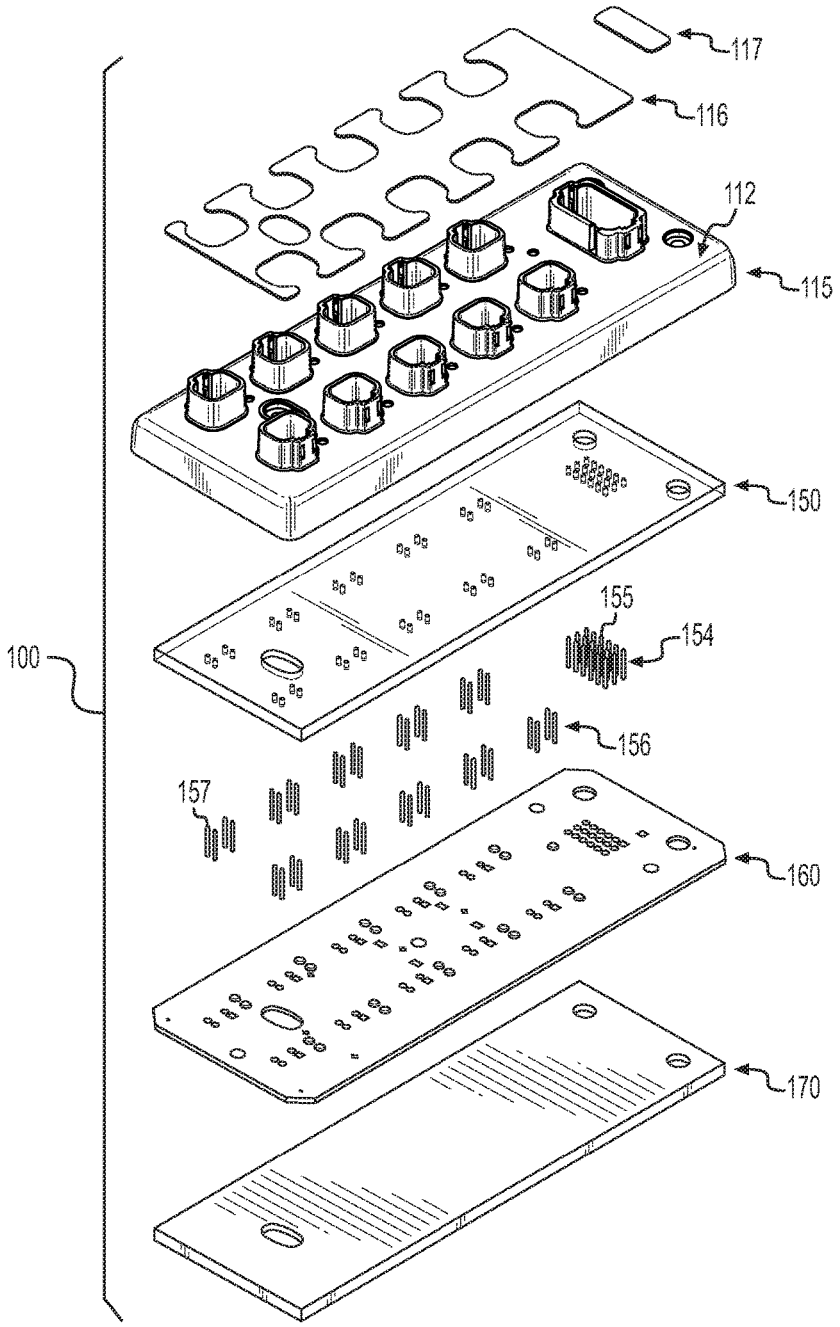
FIG. 5 is an exploded view of the power distribution module shown in FIG. 1.

FIG. 5 illustrates the components of the power distribution module 100. A pair of labels 116 and 117 is aligned on the front face 112 of the housing 115 of the power distribution module 100. Indicia identifying component parts and other useful information can be provided on the labels 116 and 117. The label 116 is configured to include one or more translucent sections that are aligned over the openings formed in the housing 115 with which the signal indicators are aligned so that light from each signal indicator can pass through the label 116 and be visible from outside the power distribution module 100. The label 116 can be configured to cover each such opening so that the label 116 acts, during the manufacturing process, as a barrier to the resin of the translucent resin layer 150, thereby preventing the resin of the translucent resin layer 150 from exiting the openings during the resin's curing stage. The housing 115 comprises the front face 112 and the sidewalls of the body 110 of the power distribution module 100. The output port sidewalls 131 of the output ports 128A, 128B, 128C, 128D, 128E, 128F, 128G, 128H, 128I, and 128J and the input port sidewall 141 of the power input port 120 are formed in the housing 115. Disposed within the housing 115 is a printed circuit board 160 that includes the internal circuitry of the power distribution module 100. The printed circuit board 160 is a printed circuit board that comprises a plurality of openings defined therein and configured to receive each of the plurality 154 of input pins 155 and each of the plurality 156 of output pins 157. The input pins 155 and the output pins 157 can be formed of hard brass, or other suitable electrically conductive metal or material, and soldered to the printed circuit board 160 to secure them in place. Each output pin 157 and each input pin 155 is connected to the printed circuit board 160 and projects into the respective output port or input port through an opening formed in the housing a the respective input or output port. A portion of each output pin 157 and each input pin 155 that projects into an input port or an output port and is circumscribed by the input port sidewall 141 or the output port sidewall 141 of the respective input port 120 or output port.

The printed circuit board 160 further comprises one or more fixed traces formed therein for transmitting current. Each of the fixed traces, represented schematically in FIGS. 8, 9 and 10, comprises one or more layers of copper rated as 2 Oz. copper, which exhibits a thickness of about 2.74 mils or about 0.0696 mm, and exhibiting a width in the range of about 7 mm to about 18 mm. The width of each fixed trace can allow for sufficient power flow without a loss of power of the circuits. The printed circuit board 160 comprises a plurality of components arranged and connected in sequence thereby creating circuits through which electricity from the vehicle's power/electrical system, can be distributed from one power cord, through the power distribution module 100, out through the output ports to electrical devices mounted on the vehicle.

Between the top surface of the printed circuit board 160 and the front face side of the housing 115 is disposed a translucent resin layer 150. The translucent resin layer 150 can be formed of an epoxy resin that seals the printed circuit board 160 and protects the printed circuit board 160 from moisture, dust and other environmental containments. The translucent resin layer 150 allows for the transmission of light there through so as to allow light generated from the light emitting diodes formed on the printed circuit board 150 to be visible through the translucent resin layer 150 outside of the power distribution module 100. The translucent resin layer 150 can be comprised of an epoxy resin, such as, for example, 3M™ Scotchcast™ Electrical Resin 5, commercially available from the 3M Company. Each input pin 155 and output pin 157 extends from the printed circuit board 160 and through the translucent resin layer 150. The translucent resin layer 150 and the thermally conductive resin layer 170 can be formed of semi-flexible resin compounds, such as those listed, that can withstand without cracking environmental shock and vibration likely to occur when mounted on a vehicle over an extend period of use.

A thermally conductive resin layer 170 is disposed adjacent the printed circuit board 160 and extends from the circuit board to the back of the power distribution module 100. The thermally conductive resin layer 170 forms a portion of the outer surface of the power distribution module 100, thereby serving as a conduit for heat generated by the circuit board 160 and the other components to be conducted outward to the environment of the power distribution module 100. The thermally conductive resin layer 170 comprises a thermally conductive resin, such as, for example, an epoxy resin. An example of an epoxy resin that can be used in the thermally conductive resin layer 170 is Insulcast® 116FR-FC available from EIS, Inc. of Atlanta, Ga., USA. The thermally conductive resin layer 170 is configured to conduct heat generated by the printed circuit board 160 during operation away from the printed circuit board 160.

FIG. 6 illustrates the alignment of the components of the power distribution module 100. The thermally conductive resin layer 170 engages the sidewalls of the housing 115 to form a water-resistant seal. The printed circuit board 160 is sandwiched between the translucent resin layer 150 and the thermally conductive resin layer 170, which cooperate, along with the housing 115, to form a water-resistant seal around the printed circuit board 160. The boss 142B is shown extending through the body 110 of the power distribution module 100 to allow for the insertion of a fastener therein and to form a barrier between the internal components of the power distribution module 100 and the environment in which the module is disposed.

Each output pin 157 is aligned within one of the ten output ports 128A, 128B, 128C, 128D, 128E, 128F, 128G, 128H, 128I, and 128J and projects out from the base of the respective port. Each input pin 155 and output pin 157 is press fit into the respective opening in the port in which it is aligned, thereby forming a seal in the opening sufficient to exclude external dust and water when temporarily submerged so as to meet the IP67 standard. Each input pin 155 and output pin 157 is friction mounted in an opening formed in the printed circuit board 160 and extends beyond both faces of the printed circuit board 160. One end of each input pin 155 and output pin 157 is disposed within the thermally conductive resin layer 170 so as to facilitate the transfer of heat from the printed circuit board 160 to the thermally conductive resin layer 170. Each output pin 157 also extends through and beyond the translucent resent layer 150 so as to be connectable to an output connector disposed in the sleeve formed by output port sidewall 131 of the respective output port.

Each of the signal indicator light emitting diodes 132B, 132D, 132F, 132H, and 132 J are shown in FIG. 6 mounted on the printed circuit board 160 and axially aligned with an opening formed in the front face 112 of the housing 115. Each of the signal indicator light emitting diodes 132B, 132D, 132F, 132H, and 132 J are encased in the translucent resin layer 150 and light from these signal indicator light emitting diodes is visible through both the translucent resin layer 150 and the respective openings in the front face 112 of the housing 115.

Figure 8:
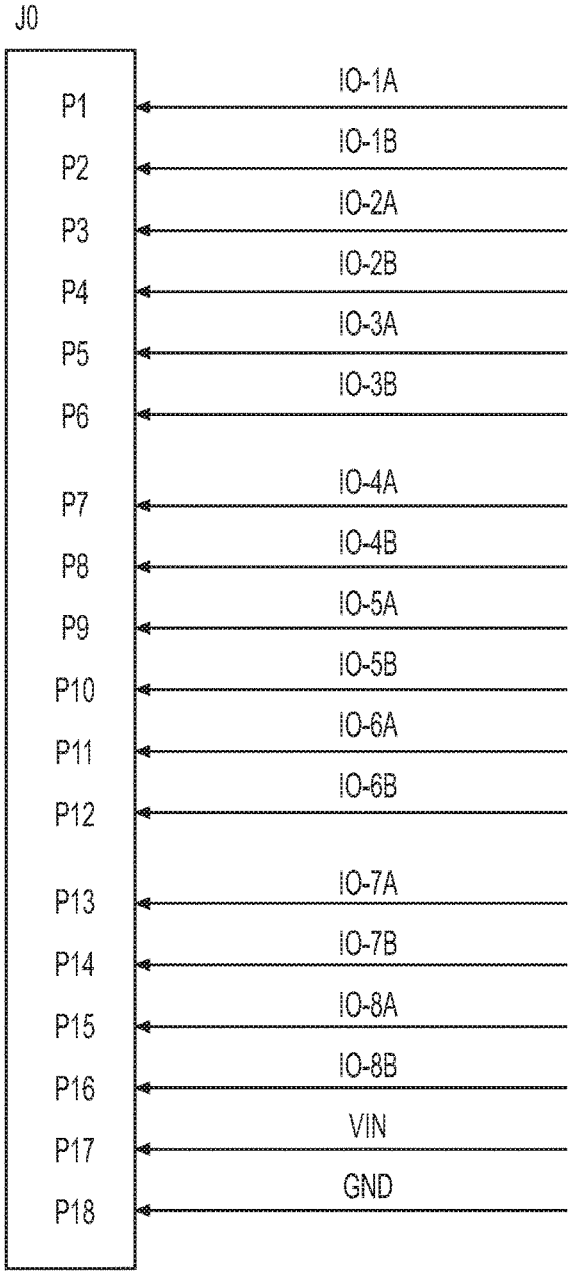
FIG. 8 shows a schematic view of the power input connector of the power distribution module shown in FIG. 2 illustrating the circuit connections leading from the power input port.

FIGS. 8 and 9 illustrate the electrical connections and circuits running on the printed circuit board 160 between the input power port 120 and each of the output ports 128A, 128B, 128C, 128D, 128E, 128F, 128G, 128H, 128I, and 128J. Twenty circuits begin at the input power port 120, schematically represented as junction J0 with eighteen separate input pins 155 identified as input pins P1, P2, P3, P4, P5, P6, P7, P8, P9, P10, P11, P12, P13, P14, P15, P16, P17, and P18. The twenty circuits are distributed from the eighteen input pins to the ten output ports 128A, 128B, 128C, 128D, 128E, 128F, 128G, 128H, 128I, and 128J, each of which includes connectors, designated E1, E2, E3, and E4 for each output port. Each of the output ports 128A, 128B, 128C, 128D, 128E, 128F, 128G, 128H, 128I, and 128J includes a junction, designated J1, J2, J3, J4, J5, J6, J7, J8, J9, and J10, respectively, in FIG. 9. Each junction of each output port includes four pins and has two signals per output port. The present disclosure encompasses power distribution modules that include output ports having two, four, or six pins.

Each signal is designated as an input/output signal and identified with the corresponding numeral of the junction of the particular output port with which the signal connects. As shown in FIG. 8, input pin P1 is connected to the input/output signal path of input/output signal IO-1A. Input pin P2 is connected to the input/output signal path of input/output signal IO-1B. Input pin P3 is connected to the input/output signal path of input/output signal IO-2A. Input pin P4 is connected to the input/output signal path of input/output signal IO-2B. Input pin P5 is connected to the input/output signal path of input/output signal IO-3A. Input pin P6 is connected to the input/output signal path of input/output signal IO-3B. Input pin P7 is connected to the input/output signal path of input/output signal IO-4A. Input pin P8 is connected to the input/output signal path of input/output signal IO-4B. Input pin P9 is connected to the input/output signal path of input/output signal IO-5A. Input pin P10 is connected to the input/output signal path of input/output signal IO-5B. Input pin P11 is connected to the input/output signal path of input/output signal IO-6A. Input pin P12 is connected to the input/output signal path of input/output signal IO-6B. Input pin P13 is connected to the input/output signal path of input/output signal IO-7A. Input pin P14 is connected to the input/output signal path of input/output signal IO-7B. Input pin P15 is connected to the input/output signal path of input/output signal IO-8A. Input pin P16 is connected to the input/output signal path of input/output signal IO-8B. Input pin P1 is the unaltered power circuit, designated VIN, and input pin 18 is connected to the ground, designated GND.

As shown in FIG. 9, junction J1 comprises the input/output signal IO-1A connected to the E4 output pin, the input/output signal IO-1B connected to the E2 output pin, the ground connected to the E3 output pin, and the power circuit connected to the E1 output pin. Junction J2 comprises the input/output signal IO-2A connected to the E4 output pin, the input/output signal IO-2B connected to the E2 output pin, the ground connected to the E3 output pin, and the power circuit connected to the E1 output pin. Junction J3 comprises the input/output signal IO-3A connected to the E4 output pin, the input/output signal IO-3B connected to the E2 output pin, the ground connected to the E3 output pin, and the power circuit connected to the E1 output pin. Junction J4 comprises the input/output signal IO-4A connected to the E4 output pin, the input/output signal IO-4B connected to the E2 output pin, the ground connected to the E3 output pin, and the power circuit connected to the E1 output pin. Junction J5 comprises the input/output signal IO-5A connected to the E4 output pin, the input/output signal IO-5B connected to the E2 output pin, the ground connected to the E3 output pin, and the power circuit connected to the E1 output pin. Junction J6 comprises the input/output signal IO-6A connected to the E4 output pin, the input/output signal IO-6B connected to the E2 output pin, the ground connected to the E3 output pin, and the power circuit connected to the E1 output pin. Junction J7 comprises the input/output signal IO-7A connected to the E4 output pin, the input/output signal IO-7B connected to the E2 output pin, the ground connected to the E3 output pin, and the power circuit connected to the E1 output pin. Junction J8 comprises the input/output signal IO-8A connected to the E4 output pin, the input/output signal IO-8B connected to the E2 output pin, the ground connected to the E3 output pin, and the power circuit connected to the E1 output pin. Junction J9 comprises the input/output signal IO-7A connected to the E4 output pin, the input/output signal IO-7B connected to the E2 output pin, the ground connected to the E3 output pin, and the power circuit connected to the E1 output pin, with this port being in a common circuit with the junction J7 of output port 128G. Junction J10 comprises the input/output signal IO-8A connected to the E4 output pin, the input/output signal IO-8B connected to the E2 output pin, the ground connected to the E3 output pin, and the power circuit connected to the E1 output pin, with this port being in a common circuit with the junction J8 of output port 128H.

Figure 10:
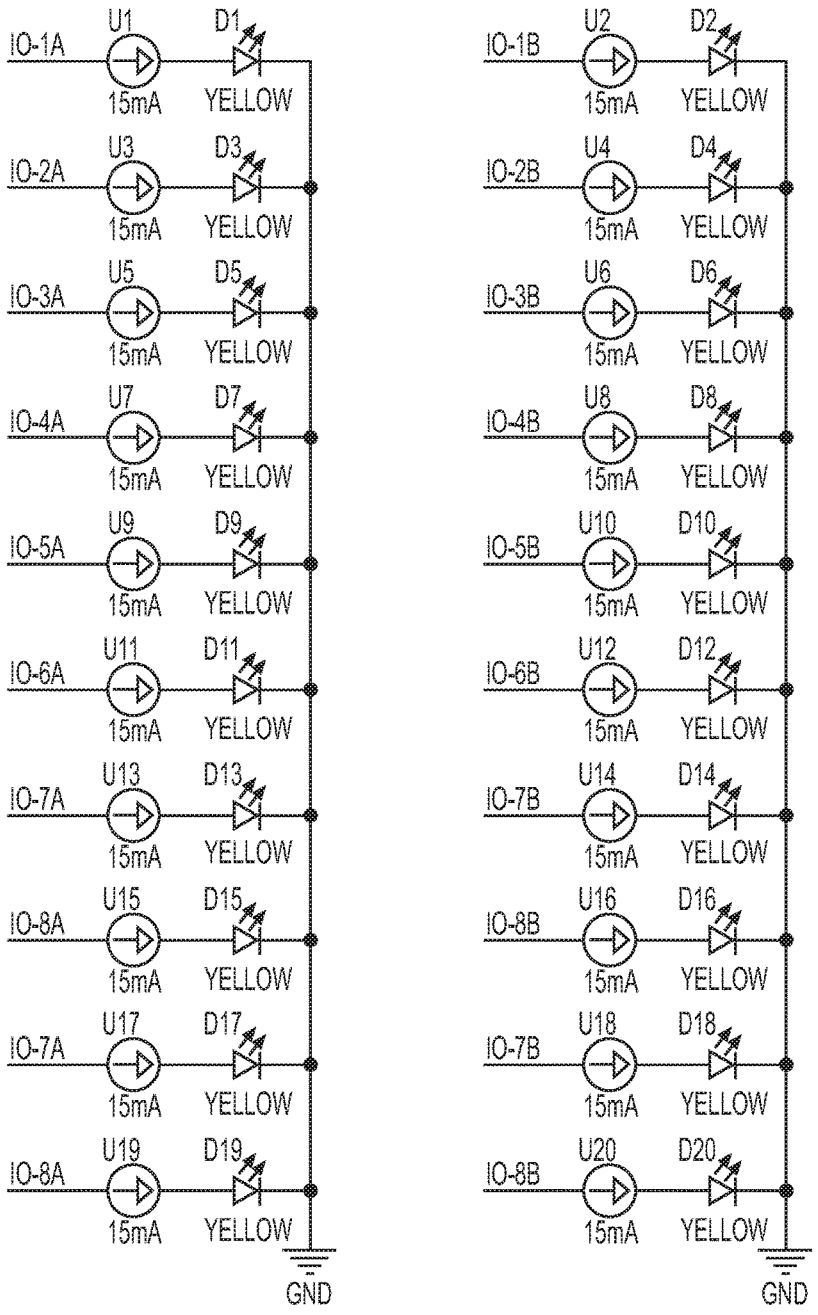
FIG. 10 illustrates a schematic view of the circuit of the LED indicator light emitting diodes of the power distribution module shown in FIG. 2.

As shown in FIG. 10, each input/output signal IO-1A, IO-1B, IO-2A, IO-2B, IO-3A, IO-3B, IO-4A, IO-4B, IO-5A, IO-5B, IO-6A, IO-6B, IO-7A, IO-7B, IO-8A, and IO-8B connects with at least one constant-current diode and at least one light emitting diode, with input/output signals IO-7A, IO-7B, and IO-8A, IO-8B each connected to two separate constant-current diodes and two separate light emitting diodes. Each of the constant-current diodes U1, U2, U3, U4, U5, U6, U7, U8, U9, U10, U11, U12, U13, U14, U15, U16, U17, U18, U19, and U19 are connected in circuit with a light emitting diode D1, D2, D3, D4, D5, D6, D7, D8, D9, D10, D11, D12, D13, D14, D15, D16, D17, D18, D19, and D20, respectively. The light emitting diodes D1, D3, D5, D7, D9, D11, D13, D15, D17, and D19, schematically represented in FIG. 10, correspond to the first signal indicator light emitting diodes 130A, 130B, 130C, 130D, 130E, 130F, 130G, 130H, 130I, and 130J, respectively, while the light emitting diode D2, D4, D6, D8, D10, D12, D14, D16, D18, and D20 correspond to the second signal indicator light emitting diodes 132A, 132B, 132C, 132D, 132E, 132F, 132G, 132H, 132I, and 132J, respectively.

Each of the constant-current diodes U1, U2, U3, U4, U5, U6, U7, U8, U9, U10, U11, U12, U13, U14, U15, U16, U17, U18, U19, and U20 is a 15 mA diode that maintains the current over a range of voltage so as to allow the connected light emitting diode to shine consistently over such voltage range.

The circuit configurations of the output ports are illustrated in FIGS. 9 and 10. For the output port 128A, the output pin E4 is connected to the input/output signal IO-1A and in circuit with the constant-current diode U1, the light emitting diode D1 and the common ground plane, and the output pin E2 is connected to the input/output signal IO-1B and in circuit with the constant-current diode U2, the light emitting diode D2 and the common ground plane. For the output port 128B, the output pin E4 is connected to the input/output signal IO-2A and in circuit with the constant-current diode U3, the light emitting diode D3 and the common ground plane, and the output pin E2 is connected to the input/output signal IO-2B and in circuit with the constant-current diode U4, the light emitting diode D4 and the common ground plane. For the output port 128C, the output pin E4 is connected to the input/output signal IO-3A and in circuit with the constant-current diode U5, the light emitting diode D5 and the common ground plane, and the output pin E2 is connected to the input/output signal IO-3B and in circuit with the constant-current diode U6, the light emitting diode D6 and the common ground plane. For the output port 128D, the output pin E4 is connected to the input/output signal IO-4A and in circuit with the constant-current diode U7, the light emitting diode D7 and the common ground plane, and the output pin E2 is connected to the input/output signal IO-4B and in circuit with the constant-current diode U8, the light emitting diode D8 and the common ground plane. For the output port 128E, the output pin E4 is connected to the input/output signal IO-5A and in circuit with the constant-current diode U9, the light emitting diode D9 and the common ground plane, and the output pin E2 is connected to the input/output signal IO-5B and in circuit with the constant-current diode U10, the light emitting diode D10 and the common ground plane.

For the output port 128F, the output pin E4 is connected to the input/output signal IO-6A and in circuit with the constant-current diode U11, the light emitting diode D11 and the common ground plane, and the output pin E2 is connected to the input/output signal IO-6B and in circuit with the constant-current diode U12, the light emitting diode D12 and the common ground plane. For the output port 128G, the output pin E4 is connected to the input/output signal IO-7A and in circuit with the constant-current diode U13, the light emitting diode D13 and the common ground plane, and the output pin E2 is connected to the input/output signal IO-7B and in circuit with the constant-current diode U14, the light emitting diode D14 and the common ground plane. For the output port 128H, the output pin E4 is connected to the input/output signal IO-8A and in circuit with the constant-current diode U15, the light emitting diode D15 and the common ground plane, and the output pin E2 is connected to the input/output signal IO-8B and in circuit with the constant-current diode U16, the light emitting diode D16 and the common ground plane. For the output port 128I, the output pin E4 is connected to the input/output signal IO-7A and in circuit with the constant-current diode U17, the light emitting diode D17 and the common ground plane, and the output pin E2 is connected to the input/output signal IO-7B and in circuit with the constant-current diode U18, the light emitting diode D18 and the common ground plane. For the output port 128I, the output pin E4 is connected to the input/output signal IO-8A and in circuit with the constant-current diode U19, the light emitting diode D19 and the common ground plane, and the output pin E2 is connected to the input/output signal IO-8B and in circuit with the constant-current diode U20, the light emitting diode D20 and the common ground plane.

The output pins 157 can be configured to carry about 13 amps of current per pin, thereby allowing about 26 amps of current to flow through each of the output ports 128A, 128B, 128C, 128D, 128E, 128F, 128G, 128H, 128I, and 128J with the two-signal configurations.

Figure 11:
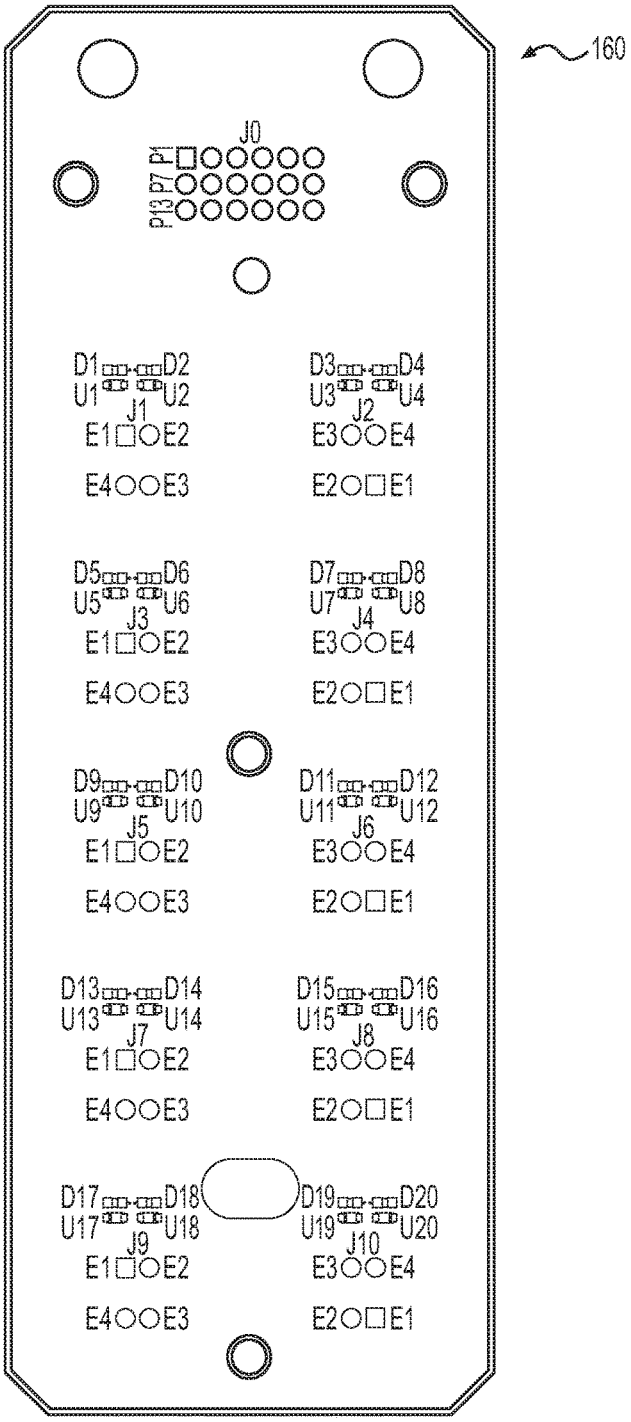
FIG. 11 illustrates a front elevation view of the printed circuit board of the power distribution module shown in FIG. 5 with selected components illustrated and alignment thereon identified.

FIG. 11 illustrates the printed circuit board 160 of the power distribution module 100 and the location of the junctions J0, J1, J2, J3, J4, J5, J6, J7, J8, J9, and J10 that correspond to the power input port 120 and the output ports 128A, 128B, 128C, 128D, 128E, 128F, 128G, 128H, 128I, and 128J, respectively. The openings for each individual input pin 155, with the location of the output pins P1, P7, and P13 individually identified, are illustrated, as well as the openings for the output pins 157, with the location of each pin E1, E2, E3, and E4 of each junction J1, J2, J3, J4, J5, J6, J7, J8, J9, and J10. FIG. 11 also illustrates the constant-current diodes U1, U2, U3, U4, U5, U6, U7, U8, U9, U10, U11, U12, U13, U14, U15, U16, U17, U18, U19, and U19, the light emitting diodes D1, D2, D3, D4, D5, D6, D7, D8, D9, D10, D11, D12, D13, D14, D15, D16, D17, D18, D19, and D20 and the location of each on the printed circuit board 160.

As illustrated in FIGS. 8-10, the power distribution module 100 can be used to connect up to ten separate electrical devices, via the ten output ports 128A, 128B, 128C, 128D, 128E, 128F, 128G, 128H, 128I, and 128J to a single power line and a single ground line. The power distribution module 100 can thereby reduce the total amount of wiring, time and effort necessary to connect an equal number of electrical devices to a vehicle's electrical system.

Figure 12:
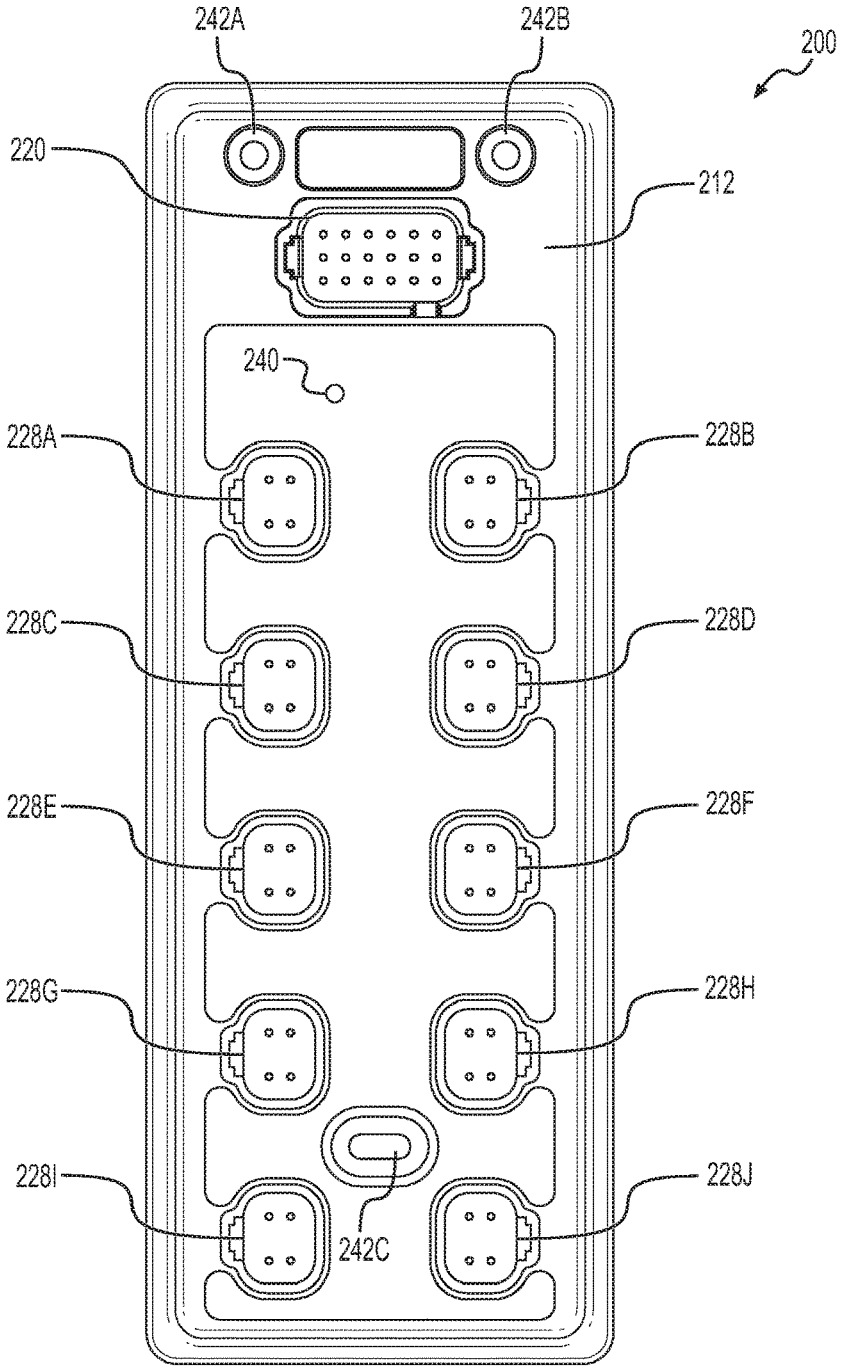
FIG. 12 illustrates a front elevation view of another power distribution module encompassed by the present disclosure.

FIG. 12 illustrates another power distribution module 200 encompassed by the present disclosure. The power distribution module 200 comprises a single input port 220, illustrated as an eighteen pin receiver for a Deutsch-type connector, and ten output ports 228A, 228B, 228C, 228D, 228E, 228F, 228G, 228H, 228I, and 228J with both the input port 220 and the output ports projecting from the front face 212 of the power distribution module 200. The power distribution module 200 also comprises three bosses 242A, 242B, and 242C, each configured to receive a fastener there through to secure the power distribution module 200 to a surface of a vehicle on which the module is mounted. A power indicator light emitting diode 240 is also provided and aligned so as to be visible from the front face 212 of the power distribution module 200. The power distribution module 200 does not include either a constant-current diode or a light emitting diode operably connected to each of the output ports 228A, 228B, 228C, 228D, 228E, 228F, 228G, 228H, 228I, and 228J.

Figure 13:
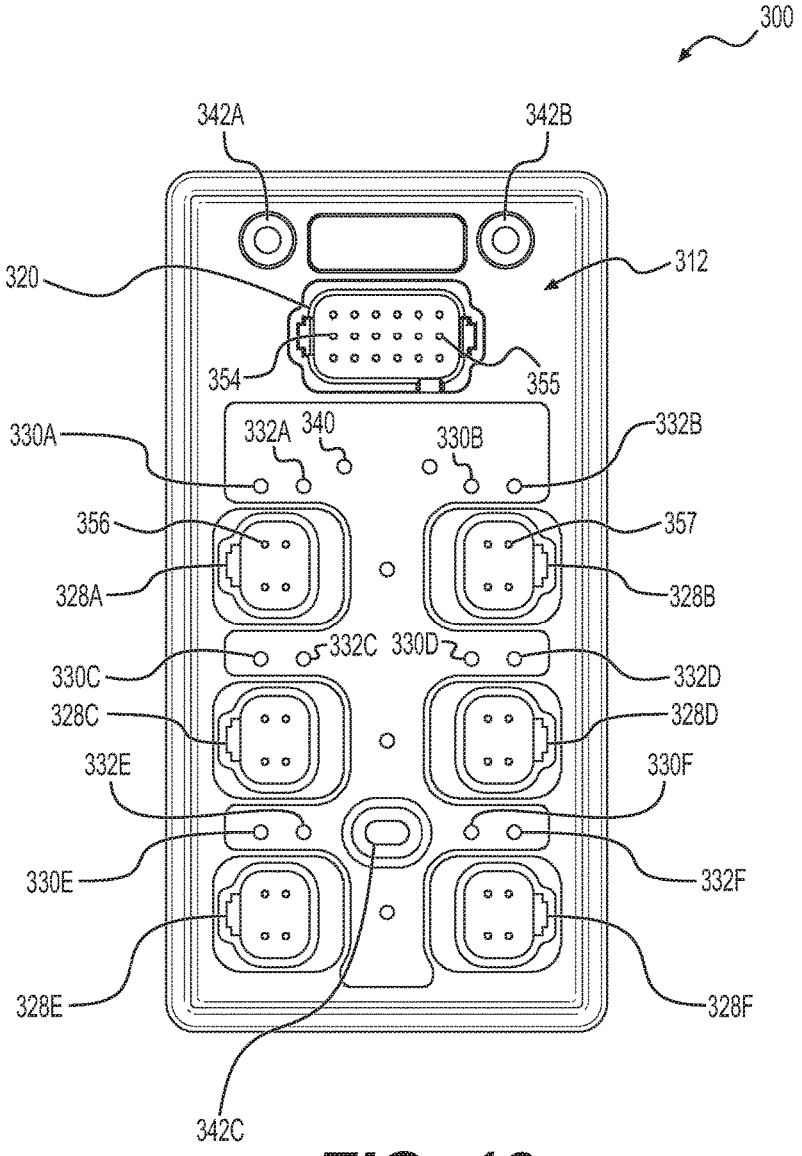
FIG. 13 illustrates a front elevation view of yet another power distribution module encompassed by the present disclosure.
Figure 14:
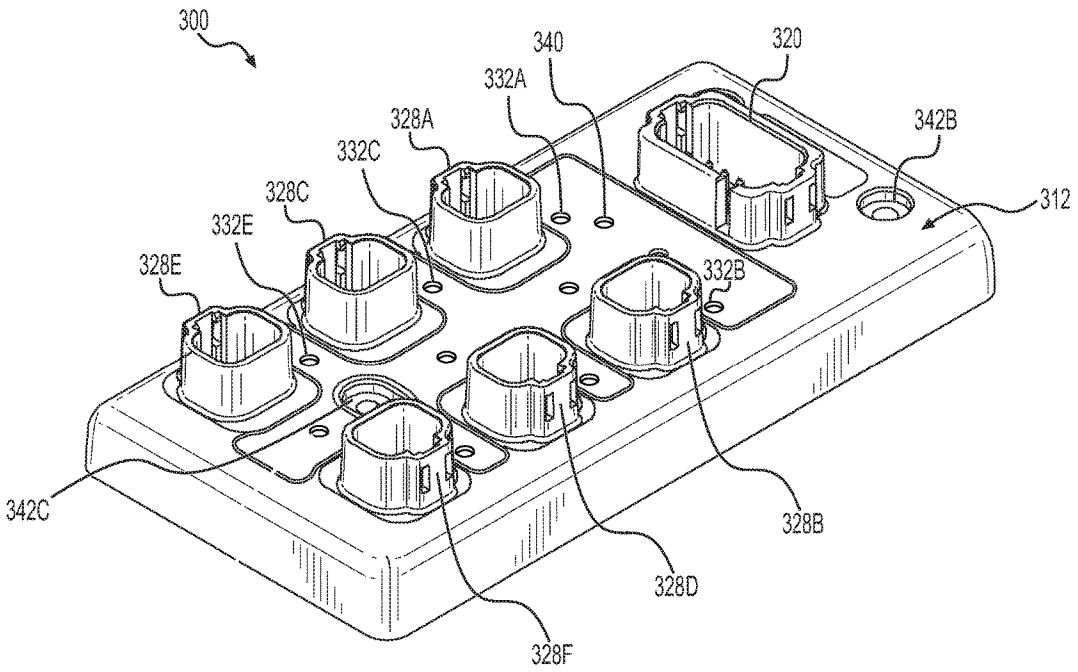
FIG. 14 illustrates a perspective view of the power distribution module shown in FIG. 13.

FIGS. 13 and 14 illustrate yet another power distribution module 300 encompassed by the present disclosure. The power distribution module 300 comprises a single eighteen pin power input port 320 and a plurality of four pin output ports 328A, 328B, 328C, 328D, 328E, and 328F with each of the power input port 320 and the output ports projecting from the front face 312 of the power distribution module 300. Each of the six output ports 328A, 328B, 328C, 328D, 328E, and 328F have aligned therewith a first signal indicator light emitting diode 330A, 330B, 330C, 330D, 330E, and 330F and a second signal indicator light emitting diode 332A, 332B, 332C, 332D, 132E, and 132F, respectively. Each first signal indicator light emitting diode 330A, 330B, 330C, 330D, 330E, and 330F and each second signal indicator light emitting diode 332A, 332B, 332C, 332D, 332E, and 332F indicates, respectively, the signal state for one of the four input pins of the respective output port as an "on" or "off" state.

Each of the power distribution modules encompassed by the present disclosure can be mounted on a vehicle and used to latchably connect, via external sealed connections, a plurality of electrical devices, also mounted on the vehicle, to a supply of electrical power connected to the vehicles power/electrical system, which includes the vehicle's motor. The power distribution modules encompassed by the present disclosure can operate in a temperature range of about −40° C. to about +85° C. and a battery voltage range of about 8 V dc to about 32 V dc. The power distribution modules encompassed by the present disclosure can be configured to survive about a 36 V dc jump start voltage for up to about 3 minutes, not be damaged by a DC battery discharge to 0 V or a reverse battery of about −27.2 V dc for about 1 minute.

The power distribution modules of the present disclosure can be used on various mobile equipment, including, but not limited to, mission-specific vehicles, such as agricultural machines, railway and construction equipment, fire and rescue trucks, road and utility maintenance vehicles, and garbage collection trucks. A power distribution module can be mounted on a suitable section of the vehicle and electrically connected to the vehicle's electrical system and one or more electrical devices mounted on the system. For example, the power distribution module 100 can be mounted on a hydraulic manifold of a mission-specific vehicle, via the insertion of a fastener into each of the three busses 142A, 142B, and 142C. A power wire assembly having a Deutsch-type eighteen pin connector formed thereon can be pushed into the power input port 120 and locked in position by the engagement by the two retention tab receivers 146A and 146B formed on each of the wedge-lock receivers 144A and 144B formed in the input port sidewall 141 of two retention tabs formed on each of the two wedge-locks formed on the connector. The push-and-lock engagement of the connector by the power input port 120 forms a water-resistant seal. The power wire assembly thereby can supply current to the power distribution module 100. One or more output wire assemblies, having Deutsch-type connectors formed thereon and in electrical communication with a corresponding number of valves of the hydraulically-operated equipment mounted on the vehicle, can be pushed into a corresponding number of output ports 128A, 128B, 128C, 128D, 128E, 128F, 128G, 128H, 128I, and 128J. Each such output wire assembly can be locked into position by the engagement of two retention tabs formed on a wedge-lock of the connector of the output wire assembly by the first output port retention tab receiver 136A and the second output port retention tab receiver 136B formed on the output port wedge-lock receiver 134 formed in the corresponding output port sidewall 131 of each output port 128A, 128B, 128C, 128D, 128E, 128F, 128G, 128H, 128I, and 128J, thereby forming a water-resistant seal between the connector and the output port. Current can thereby be provided from the vehicle's electrical system to each such connected valve. The power distribution modules encompassed by the present disclosure can be used in conjunction with a wide variety of electrically powered devices mounted on mobile equipment.

It will be apparent to those skilled in the art that various modifications and variations can be made to the power distribution modules, mechanisms and components thereof set forth herein and such modifications and variations are contemplated and encompassed by the present disclosure.

What is claimed is:

1. A power distribution module for use on mobile equipment comprising:

a housing comprising a front face;

a power input port integrally formed with the housing, wherein the power input port comprises an input port sidewall, a first input port wedge-lock receiver formed in the input port sidewall, a second input port wedge-lock receiver formed in the input port sidewall, a first input port wedge-lock retention tab receiver formed in the first input port wedge-lock receiver, and a second input port wedge-lock retention tab receiver formed in the second wedge-lock receiver;

a plurality of output ports integrally formed with the housing, wherein each output port of the plurality of output ports comprises an output port sidewall, an output port wedge-lock receiver formed in the output port sidewall, and an output port wedge-lock retention tab receiver formed in the output port wedge-lock receiver;

a printed circuit board disposed within the housing, wherein the printed circuit board comprises an input port junction and a plurality of output port junctions, wherein each output port junction of the plurality of output port junctions is in electrical communication with the input port junction;

a plurality of input pins connected to the printed circuit board at the input port junction, wherein each input pin of the plurality of input pins is operably aligned with the power input port;

a plurality of output pins connected to the printed circuit board, wherein each output pin of the plurality of output pins is connected to the printed circuit board at one output port junction of the plurality of output port junctions, and wherein each output pin of the plurality of output pins is operably aligned with one output port of the plurality of output ports;

a light emitting diode connected to the printed circuit board, wherein the light emitting diode is in electrical communication with the input port junction;

a translucent resin layer disposed between at least a portion of the printed circuit board and the housing, wherein the light emitting diode is disposed between the translucent resin layer and the printed circuit board, and wherein the translucent resin layer contacts at least a portion of the printed circuit board; and, a thermally conductive resin layer disposed adjacent the printed circuit board, wherein the thermally conductive resin layer contacts at least a portion of the printed circuit board.

2. The power distribution module of claim 1, wherein the printed circuit board further comprises a fixed trace connected to the input port junction and at least one output port junction of the plurality of output port junctions.

3. The power distribution module of claim 2, wherein the fixed trace comprises copper.

4. The power distribution module of claim 3, wherein the fixed trace exhibits a width in the range of about 7 mm to about 18 mm.

5. The power distribution module of claim 4, wherein the fixed trace exhibits a thickness of about 0.07 mm.

6. The power distribution module of claim 1, wherein the translucent resin layer and the thermally conductive resin layer cooperate to encase the printed circuit board.

7. The power distribution module of claim 6, wherein a portion of each output pin of the plurality of output pins is disposed in the thermally conductive resin layer.

8. The power distribution module of claim 6, wherein a portion of each output pin of the plurality of output pins projects through the translucent resin layer into one output port of the plurality of output ports.

9. The power distribution module of claim 1, wherein the plurality of output ports is aligned on the front face of the housing.

10. The power distribution module of claim 9, wherein the power input port is aligned on the front face of the housing.

11. The power distribution module of claim 1, wherein the power input port comprises eighteen input pins disposed therein, wherein each input pin of the eighteen input pins is connected to the input port junction.

12. The power distribution module of claim 1, wherein each output port of the plurality of output ports comprises four output pins disposed therein, wherein each output pin of the four output pins is connected to one output port junction of the plurality of output port junctions.

13. The power distribution module of claim 1, further comprising a plurality of first input/output signal paths formed on the printed circuit board and a plurality of second input/output signal paths formed on the printed circuit board, wherein each output port junction of the plurality of output port junctions is connected to one input/output signal path of the first plurality of input/output signal paths and to one input/output signal path of the second plurality of input/output signal paths, and wherein the input port junction is connected to each input/output signal path of the plurality of first input/output signal paths and to each input/output signal path of the plurality of second input/output signal paths, and wherein each output port junction of the plurality of output port junctions is in electrical communication with the input port junction through one input/output signal path of the first plurality of input/output signal paths and through one input/output signal path of the second plurality of input/output signal paths.

14. The power distribution module of claim 13, wherein each output port junction of the plurality of output port junctions is in electrical communication with one constant-current diode of a first plurality of constant-current diodes and one light emitting diode of a first plurality of light emitting diodes.

15. The power distribution module of claim 14, wherein each output port junction of the plurality of output port junctions is in electrical communication with one constant-current diode of a second plurality of constant-current diodes and one light emitting diode of a second plurality of light emitting diodes.

16. A power distribution module for use on mobile equipment comprising:

a housing comprising a front face, wherein the housing comprises a glass-filled nylon 6,6 polymeric compound;

a power input port integrally formed on the front face of the housing, wherein the power input port comprises an input port sidewall, a first input port wedge-lock receiver formed in the input port sidewall, a second input port wedge-lock receiver formed in the input port sidewall, a first input port wedge-lock retention tab receiver formed in the first input port wedge-lock receiver, and a second input port wedge-lock retention tab receiver formed in the second wedge-lock receiver, wherein the power input port comprises a glass-filled nylon 6,6 polymeric compound;

a plurality of output ports integrally formed on the front face of the housing, wherein each output port of the plurality of output ports comprises an output port sidewall, an output port wedge-lock receiver formed in the output port sidewall, and an output port wedge-lock retention tab receiver formed in the output port wedge-lock receiver, wherein each output port of the plurality of output ports comprises a glass-filled nylon 6,6 polymeric compound;

a printed circuit board disposed within the housing, wherein the printed circuit board comprises an input port junction, a plurality of output port junctions, and a fixed trace connected to the input port junction and each output port junction of the plurality of output port junctions, wherein each of the plurality of output port junctions is in electrical communication with the input port junction;

a plurality of input pins connected to the printed circuit board at the input port junction, wherein each of the plurality of input pins are operably aligned with and press fitted into the power input port;

a plurality of output pins connected to the printed circuit board, wherein each of the plurality of output pins is connected to the printed circuit board at one output port junction of the plurality of output port junctions, and wherein each output pin of the plurality of output pins is operably aligned with and press fitted into one output port of the plurality of output ports;

a plurality of light emitting diodes disposed on the printed circuit board, wherein each output port junction of the plurality of output port junctions is in electrical communication with at least one light emitting diode of the plurality of light emitting diodes;

a plurality of constant-current diodes disposed on the printed circuit board, wherein each constant-current diode of the plurality of constant-current diodes is in electrical communication with one output port junction of the plurality of output port junctions and one light emitting diodes of the plurality of light emitting diodes;

a translucent resin layer disposed between at least a portion of the printed circuit board and the housing, wherein the translucent resin layer is disposed between the plurality of light emitting diodes and the housing, and wherein the translucent resin layer contacts at least a portion of the printed circuit board; and, a thermally conductive resin layer disposed adjacent the printed circuit board, wherein the thermally conductive resin layer contacts at least a portion of the printed circuit board, wherein the printed circuit board is sealed by the translucent resin layer and the thermally conductive resin layer.

* * * * *